US006431672B1

(12) United States Patent
Ardito et al.

(10) Patent No.: US 6,431,672 B1
(45) Date of Patent: Aug. 13, 2002

(54) INK CONTAINER HAVING DUAL CAPILLARY MEMBERS WITH DIFFERING CAPILLARY PRESSURES FOR PRECISE INK LEVEL SENSING

(75) Inventors: Michael S. Ardito, Lebanon; Ray A. Walker, Eugene; Jeffrey L. Thielman, Corvallis, all of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/798,612

(22) Filed: Mar. 1, 2001

(51) Int. Cl.[7] ..... B41J 2/195
(52) U.S. Cl. ..... 347/7
(58) Field of Search ..... 347/7, 6, 20, 5, 347/1, 68, 95, 48, 49, 139 R; 73/861

(56) References Cited

U.S. PATENT DOCUMENTS 6,334,669 B1 * 1/2002 Kudo et al.

* cited by examiner

*Primary Examiner*—Raquel Yvette Gordon

(57) ABSTRACT

A replaceable ink container for providing ink to a printhead of a printing system. The ink container has a fluid outlet configured for connection with the printhead. The ink container includes an ink reservoir having a first capillary member having a first capillary pressure, and a second capillary member having a second capillary pressure that is greater than the first capillary pressure such that the second capillary member has a higher resistance to ink flow than the first capillary member. An ink level sensor senses a low ink condition of the ink reservoir. The ink level sensor includes a C-shaped tube having first and second ports that fluidically communicate with only the second capillary member. The first and second capillary members abut one another at a capillary member interface, and the first port is positioned immediately adjacent to this capillary member interface. Placement of the first port immediately adjacent to the capillary member interface minimizes the ink level variation between an ink drained portion of the second capillary member and an ink filled portion of the second capillary member. A light detector detects when the C-shaped tube is free of ink which defines the low ink condition of the ink reservoir.

36 Claims, 8 Drawing Sheets

INK CONTAINER HAVING DUAL CAPILLARY MEMBERS WITH DIFFERING CAPILLARY PRESSURES FOR PRECISE INK LEVEL SENSING

TECHNICAL FIELD

This invention relates generally to ink jet printing devices. In particular, the present invention is an ink container having an ink reservoir fluidically coupled to an ink outlet. The ink reservoir is defined by a first capillary member positioned adjacent the ink outlet and a second capillary member spaced from the ink outlet by the first capillary member. The first capillary member has a high resistance to the flow of ink while the second capillary member has a low resistance to the flow of ink. An ink level sensing feature positioned adjacent the interface of the first and second capillary members provides a reliable and accurate indication of a low ink condition in the ink reservoir of the ink container.

BACKGROUND OF THE INVENTION

Ink jet printing systems frequently make use of an ink jet printhead mounted within a carriage that is moved back and forth across print media, such as paper. As the printhead is moved across the print media, a control system activates the printhead to deposit or eject ink droplets onto the print media to form images and text. Ink is provided to the printhead by a supply of ink that is either carried by the carriage or mounted to the printing system such that the supply of ink does not move with the carriage. For the case where the ink supply is not carried with the carriage, the ink supply can be in fluid communication with the printhead to replenish the printhead or the printhead can be intermittently connected with the ink supply by positioning the printhead proximate to a filling station to which the ink supply is connected whereupon the printhead is replenished with ink from the refilling station.

For the case where the ink supply is carried with the carriage, the ink supply may be integral with the printhead whereupon the entire printhead and ink supply is replaced when ink is exhausted. Alternatively, the ink supply can be carried with the carriage and be separately replaceable from the printhead or drop ejection portion.

Regardless of where the supply of ink is located within the printing system, it is critical that the printhead be prevented from operating when the supply of ink is exhausted. Operation of the printhead once the supply of ink is exhausted results in poor print quality, printhead reliability problems, and, if operated for a sufficiently long time without a supply of ink, can cause catastrophic failure of the printhead. This catastrophic failure results in permanent damage to the printhead. Therefore, it is important that the printing system be capable of reliably identifying a condition in which the ink supply is nearly or completely exhausted. In addition, the identification of the condition of a nearly or completely exhausted ink supply should be accurate, reliable, and relatively low cost, thereby tending to reduce the cost of the ink supply and the printing system.

One type of ink container including a capillary reservoir with a binary ink level sensor is disclosed in the U.S. Pat. No. 5,079,570 to Mohr et al. entitled "Capillary Reservoir Binary Ink Level Sensor" which is assigned to the same assignee as the instant application and which is incorporated herein in its entirety by reference thereto. As illustrated in prior art FIG. 2 of the instant application, Mohr et al. is directed to an ink container 10 that includes a housing 12 within which is provided a capillary reservoir 14 for storing a quantity of ink. In prior art FIG. 2, the capillary reservoir 14 has dashed horizontal lines where there is ink and no dashed horizontal lines where there is no ink. On one end of the housing 12 is an ink outlet 16.

An ink level sensor 18 is provided on one surface of the housing 12. The sensor 18 comprises a C-shaped, transparent, ink level sensing tube 20 with first arm or port 20*a* a first distance above the outlet 16 and a second arm or port 20*b* a shorter distance above the outlet 16. Both the first and second ports 20*a*, 20*b* are ported through the housing 12 to the capillary reservoir 14. In operation, as long as the ink level 22 is above the first port 20*a*, the tube 20 of the ink level sensor 18 is full of ink and is in static equilibrium. However, when the ink level 22 reaches the top port 20*a*, the ink is sucked from the tube 20 of the ink level sensor 18 and into the capillary reservoir 14 due to an imbalance in the capillary pressures at the ink/air interfaces between the capillary reservoir 14 and the top port 20*a*. The resulting sudden (i.e., instantaneous) depletion of ink in the tube 20 of the ink level sensor 18 provides a binary fluidic indicator. Since the tube 20 of the ink level sensor 18 is transparent, a sensing device, such as light detector 24, positioned adjacent to the tube 20, can detect when the tube 20 is empty (i.e., detect the binary fluidic indicator), whereupon a printing system controller (not shown), coupled to the light detector 24 via transmission line 26, can notify a user of the low ink condition of the ink reservoir 14 of the ink container 10.

A drawback of the ink container 10 is that as ink is drained from the ink reservoir 14, the ink level 22, otherwise known as an ink front, since it forms a dividing line between an ink filled portion 28 of the ink reservoir 14 and an empty portion 30 of the reservoir 14, is very uneven and ever-changing. This uneven ink front 22 (i.e., ink level) exhibits an ink front variation 32 defined by the difference between a highest point 34 of the ink filled portion 28 of the ink reservoir 14 and a lowest point 36 of the empty portion 30 of the ink reservoir 14. This ink front variation 32 causes variation in the time at which the ink front 22 reaches the top port 20*a* of the ink level sensing tube 20 and the tube 20 drains. The greater the ink front variation 32 (i.e., unevenness), the greater the uncertainty in the amount of ink in the ink cartridge 10 at the time the ink level sensing tube 20 is drained. Moreover, because of this ink front variation 32, the time required for the ink front 22 to reach the ink level sensing tube 20 (i.e., the timing of the binary fluidic signal indicating a low ink condition for the ink container 10) can vary from one ink container 10 to the next. As such, it is relatively difficult for a printing system to precisely determine what the ink level is in any given ink container 10.

There is a need for an ink container that allows a printing system to reliably and accurately determine the ink level within an ink reservoir of the ink container. The ink container design should substantially eliminate the container-to-container variation in the indication of a low ink condition with an ink container. In other words, the binary fluidic signal for a low ink condition produced by an ink level sensor should occur in each and every container at substantially the same targeted ink level (i.e., with substantially the same amount of ink remaining in each and every ink container). Lastly, the ink container should be relatively easy and inexpensive to manufacture.

SUMMARY OF THE INVENTION

The present invention is a replaceable ink container for providing ink to a printhead of a printing system. The ink container has a fluid outlet configured for connection with the printhead. The ink container includes an ink reservoir having a first capillary member having a first capillary pressure, and a second capillary member having a second capillary pressure that is different than the first capillary pressure.

In one aspect of the present invention, the second capillary pressure is greater than the first capillary pressure such that the second capillary member has a higher resistance to ink flow than the first capillary member. In another aspect of the present invention, an ink level sensor senses a low ink condition of the ink reservoir. The ink level sensor includes a C-shaped tube mounted to the ink container. The C-shaped tube has first and second ports that fluidically communicate with only the second capillary member. The first and second capillary members abut one another at a capillary member interface, and the first port is positioned immediately adjacent to this capillary member interface. In a further aspect of the present invention, the C-shaped tube is transparent, and a light detector detects when the C-shaped tube is free of ink which defines the low ink condition of the ink reservoir. In still a further aspect of the present invention, the ink level sensor is a pressure sensor for sensing a change in back pressure within the ink reservoir at the capillary member interface.

In another embodiment, the present invention provides a replaceable ink container for providing ink to a printhead of a printing system. The ink container has a fluid outlet configured for connection with the printhead. The ink container includes an ink reservoir having a first capillary member, and a second capillary member that is different than the first capillary member. An ink level sensor determines an amount of ink in the ink reservoir.

In a further embodiment, the present invention provides a replaceable ink container for providing ink to a printhead of a printing system. The ink container has a fluid outlet configured for connection with the printhead. The ink container includes an ink reservoir having a first capillary member, and a second capillary member that is different than the first capillary member and is positioned immediately adjacent to the fluid outlet. The first capillary member is spaced from the fluid outlet by the second capillary member, and the first and second capillary members abut one another at a capillary member interface. An ink level sensor determines an amount of ink in the ink reservoir, with the ink level sensor being positioned immediately adjacent the capillary member interface so as to be in fluid communication with the ink reservoir.

In still a further embodiment, the present invention provides a replaceable ink container for providing ink to a printhead of a printing system. The ink container has a fluid outlet configured for connection with the printhead. The ink container includes an ink reservoir and an ink level pressure sensor. The ink level pressure sensor determines an amount of ink in the ink reservoir, with the ink level pressure sensor sensing a change in back pressure within the ink reservoir.

In still another embodiment, the present invention provides a replaceable ink container for providing ink to a printhead of a printing system. The ink container has a fluid outlet configured for connection with the printhead. The ink container includes an ink reservoir having at least one capillary member, and one additional capillary member. The one additional capillary member abuts the at least one capillary member at a capillary member interface, such that at the capillary member interface, the one additional capillary member has an ink level variation between an ink drained portion of the one additional capillary member and an ink filled portion of the one additional capillary member that is minimal.

This ink container allows a printing system to reliably and accurately determine the ink level within the ink reservoir of the ink container. In particular, by providing the ink reservoir with a second capillary member having a greater capillary pressure than a first capillary member of the ink reservoir, the ink within the ink reservoir will drain first from the first capillary member and then from the second reservoir. Placement of the ink level sensor immediately adjacent to the capillary member interface (or sensing a change in back pressure at this interface) between the first and second capillary members, with the ink level sensor in fluid communication with only the second capillary member, minimizes the ink level variation between an ink drained portion of the second capillary member and an ink filled portion of the second capillary member. By minimizing the ink level variation at the ink level sensor, the container-to-container variation in the indication of a low ink condition of an ink container is substantially eliminated. In other words, the binary fluidic signal for a low ink condition produced by an ink level sensor occurs in each and every container at substantially the same targeted ink level (i.e., with substantially the same amount of ink remaining in each and every ink container). Lastly, the ink container of the present invention is relatively easy and inexpensive to manufacture.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
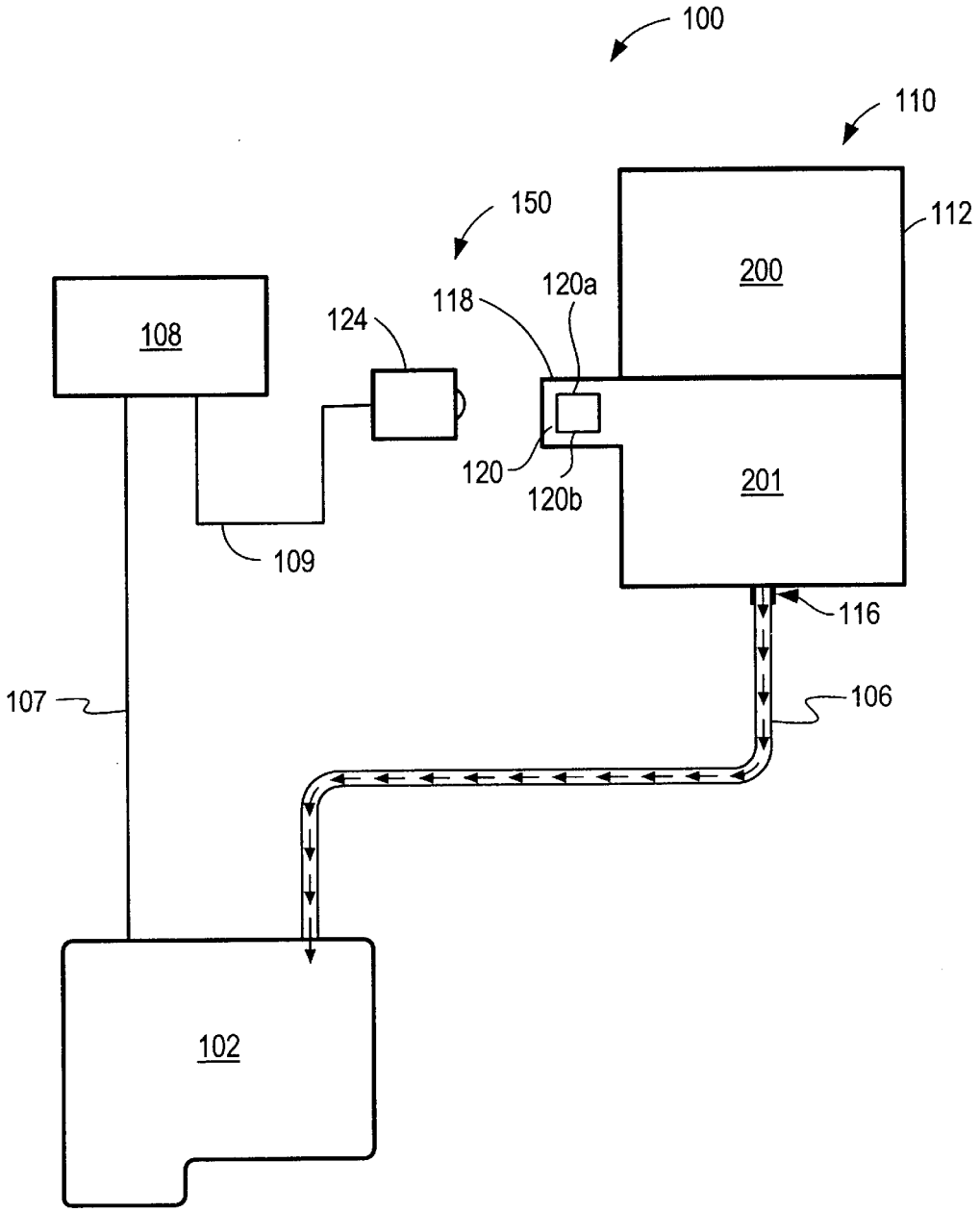
FIG. 1 is a schematic drawing of a printing system having a replaceable ink container with dual capillary members and ink level sensor in accordance with the present invention.
Figure 2:
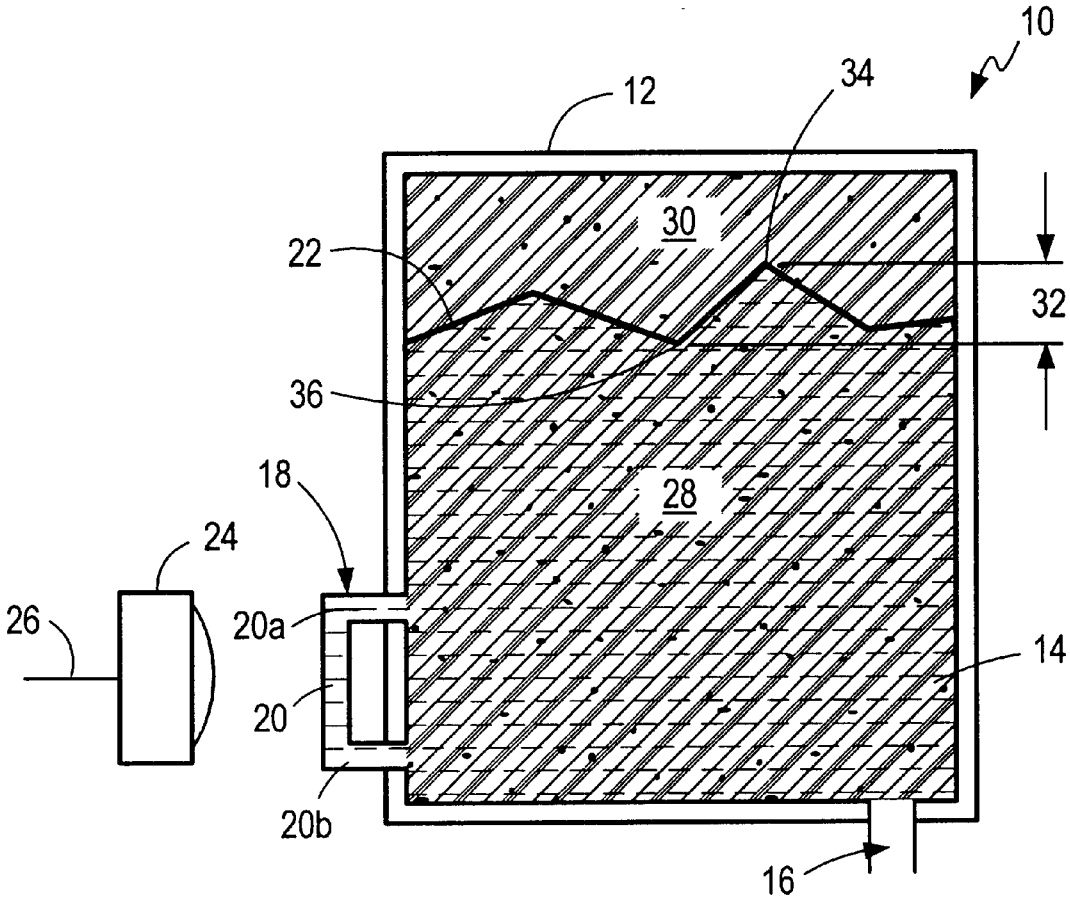
Fig. 2 (Prior Art)
FIG. 2 is a sectional view of a prior art replaceable ink container having a single capillary member and ink level sensor.

FIG. 1 depicts a schematic representation of an ink jet printing system 100 which includes a replaceable ink container 110 in accordance with the present invention. As seen in FIGS. 3A–3D, the ink container 110 includes a housing 112 within which is provided a capillary reservoir otherwise known as an ink reservoir 114 for storing a quantity of ink. In FIGS 3A–3D, the ink reservoir 114 has dashed horizontal lines where there is ink and no dashed horizontal lines where there is no ink. On one end of the housing 112 is an ink outlet otherwise known as a fluid outlet 116 which is in fluid communication with the ink reservoir 114.

As seen in FIG. 1, the fluid outlet 116 is releasably, fluidically coupled by way of a conduit 106 to an ink jet printhead 102 of the printing system 100. In the case of an "off-axis" printing system, the conduit 106 is typically flexible. In the case of an "on-axis" printing system, the conduit is typically forms a rigid portion of a manifold that receives the ink container 110. The ink container 110 provides ink to the printhead 102 for ejection onto media, such as paper. The printhead 102 is further linked by way of signal transmission line 107 to printer control electronics 108 of the printing system 100. The printer control electronics 108 control various printing system 100 functions such as, but not limited to, printhead 102 activation to dispense ink and notification of a printing system 100 user of a low ink condition within the ink container 110. In order to notify a user of a low ink condition and/or out of ink condition within the ink container 110, the printer control electronics 108 is linked by way of a signal transmission line 109 to a sensor, such as a photo detector otherwise known as a light detector 124. The light detector 124 forms part of a first embodiment of an ink level sensing mechanism 150 of the printing system 100. The ink level sensing mechanism 150 determines an amount of ink with the ink reservoir 114. In particular, the ink level sensing mechanism 150, which will be described more fully below, precisely senses an ink level condition of the ink reservoir 114 of the ink container 110.

As seen in FIGS. 1 and 3A–3D, the ink reservoir 114 is defined by a first capillary member 200 having a first capillary pressure and a second capillary member 201 having a second capillary pressure that is different than the first capillary pressure. Specifically, the second capillary pressure is greater than the first capillary pressure such that the second capillary member 201 has a higher resistance to ink flow than the first capillary member 200. To achieve this difference in capillary pressure between the first and second capillary members 200, 201, the first capillary member 200 is designed to be more porous than the second capillary member 201. In essence, the first capillary member 200 has larger pores than the second capillary member 201. Alternatively, the first and second capillary members 200, 201 may have the same structure, except that the second capillary member 201 may be positioned within the housing 112 in a greater compressed state than the first capillary member 200 to achieve the greater resistance to ink flow of the second capillary member 201 relative to the first capillary member 200.

The second capillary member 201 is positioned within the housing 112 of the ink container 110 immediately adjacent to the fluid outlet 116. The first capillary member 200 is positioned within the housing 112 so as to be spaced from the fluid outlet 116 by the second capillary member 201. The first capillary member 200 is stacked vertically on top of the second capillary member 201 in a gravity frame of reference. The first and second capillary members 200, 201 abut one another, so as to be in fluid communication, at a capillary member interface 300. As seen in FIGS. 3A–3D, the first capillary member 200 defines at least half of the ink reservoir 114 by volume. In one preferred embodiment, the first capillary member 200 defines two-thirds of the ink reservoir 114 by volume with the second capillary member 201 defining the remaining one-third of the ink reservoir 114 by volume.

As seen best in FIGS. 3A–3D, the first embodiment of ink level sensing mechanism 150, along with the light detector 124, includes an ink level sensor 118. The ink level sensor 118 is provided on one surface of the housing 112 and comprises a C-shaped, transparent, ink level sensing tube 120 with first arm or upper port **120*a* a first vertical distance above the fluid outlet 116, and a second arm or lower port 120*b* a shorter vertical distance above the fluid outlet 116. Both the upper and lower ports 120*a*, 120*b* are ported through the housing 112 to fluidically communicate with the ink reservoir 114. In particular, the upper and lower ports 120*a*, 120*b* fluidically communicate with only the second capillary member 201. As seen in FIGS. 3A–3D, the upper port 120*a* is positioned, so as to fluidically communicate only with the second capillary member 201, immediately adjacent to the capillary member interface 300. The light detector 124 of the first embodiment ink level sensing mechanism 150 is positioned adjacent to the C-shaped, transparent tube 120 of the ink level sensor 118**.

Figure 3A:
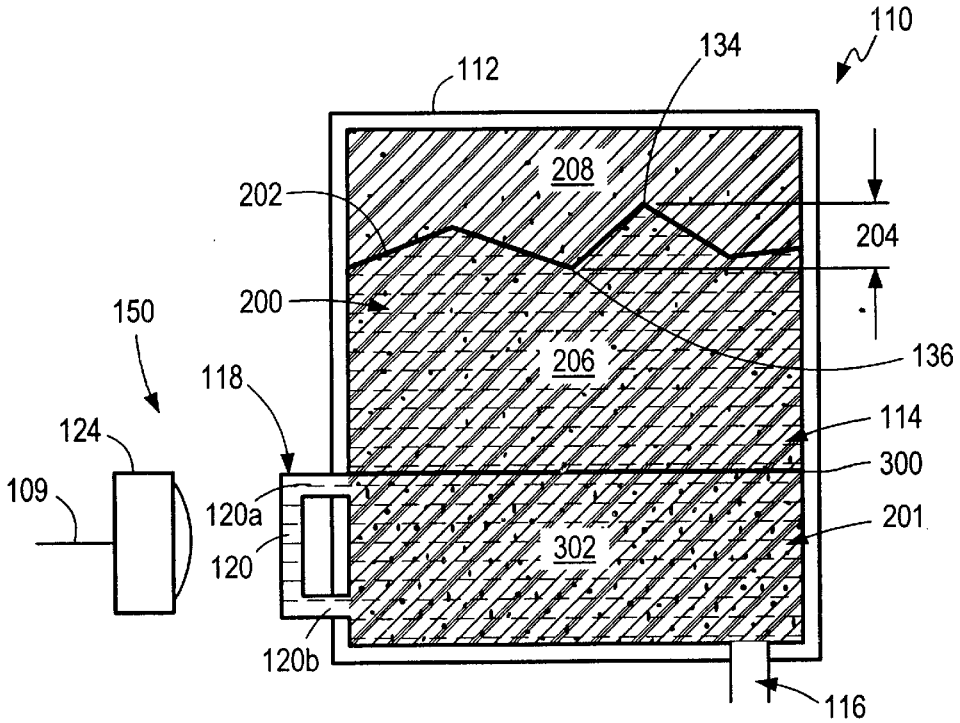
FIGS. 3A, 3B, 3C and 3D are sectional views depicting ink usage in the replaceable ink container of FIG. 1 in accordance with the present invention.
Figure 3B:
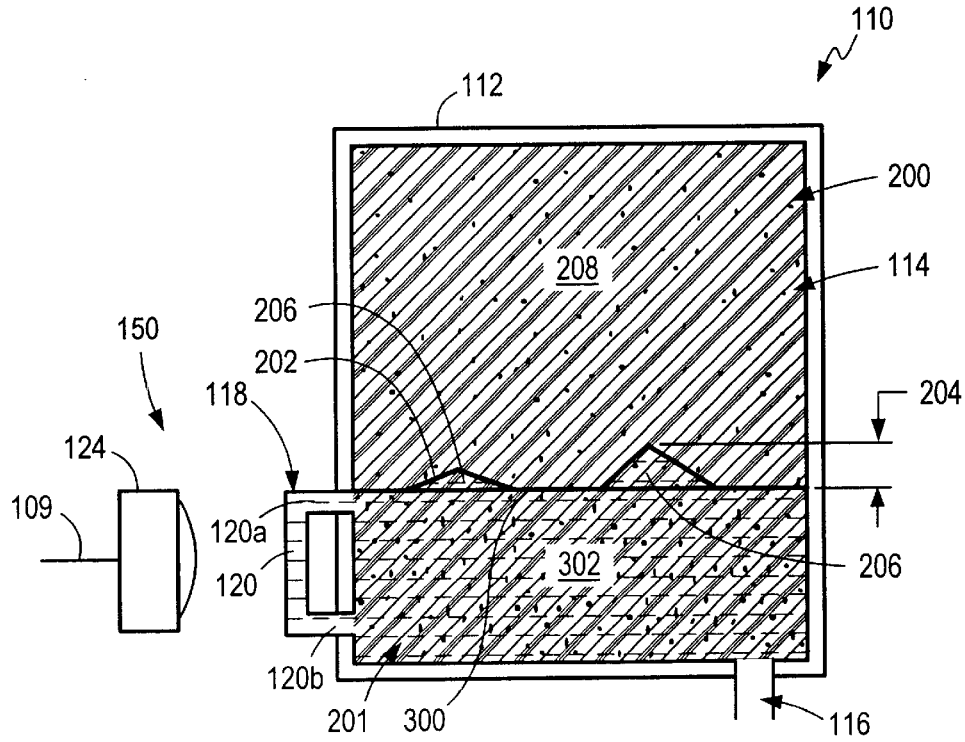
Figure 3C:
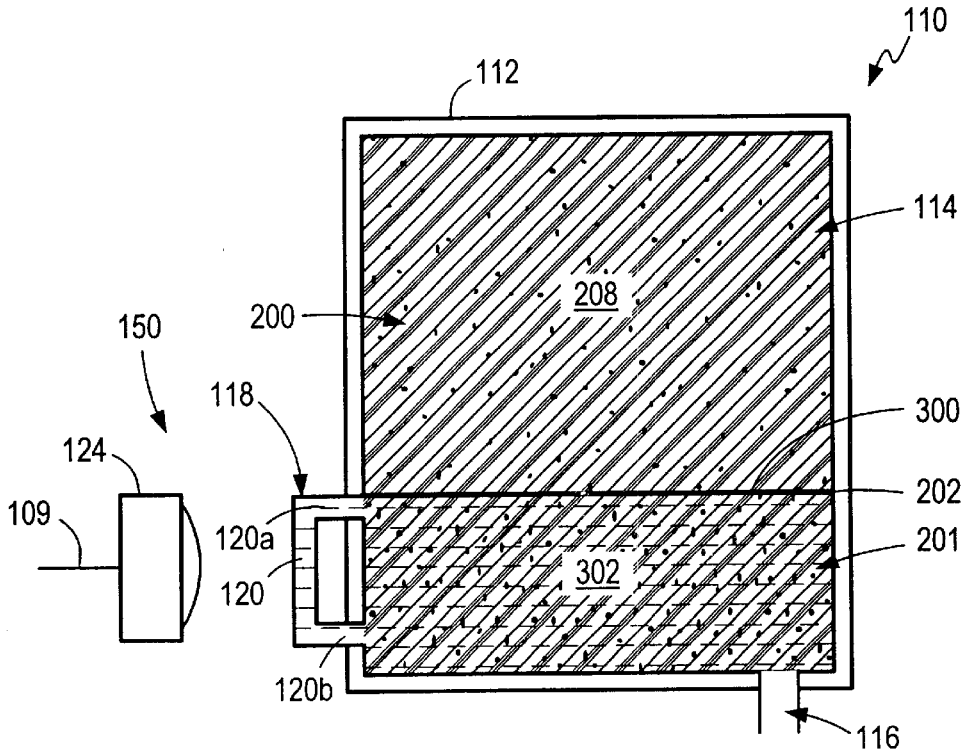
Figure 3D:
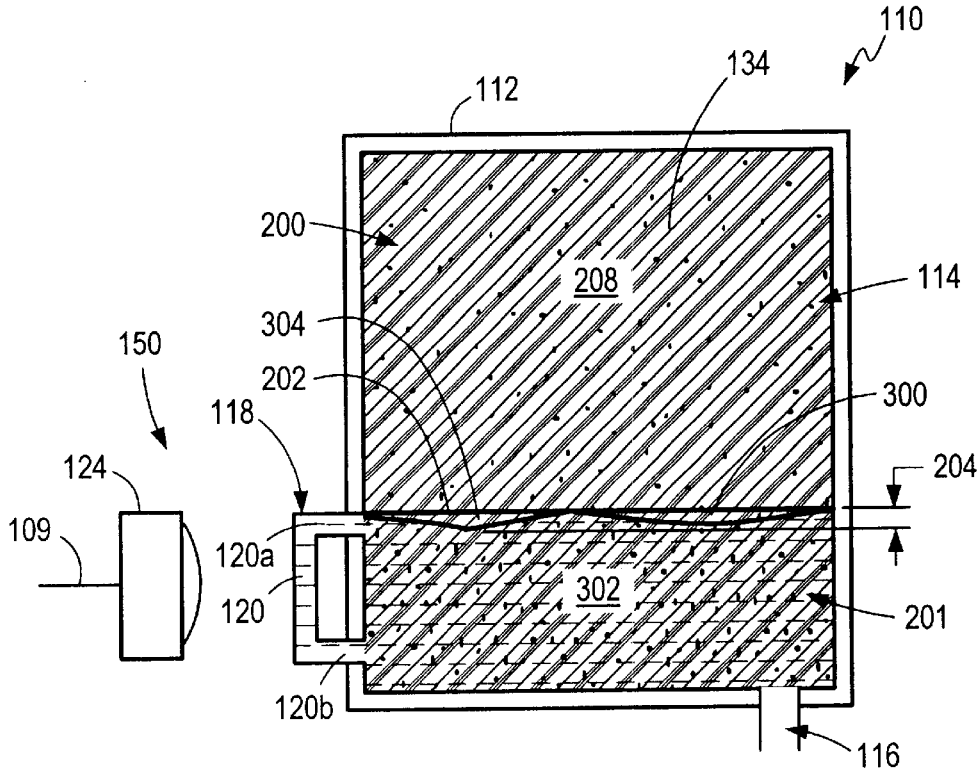

Operation of the ink level sensor 118 of the first embodiment ink level sensing mechanism 150 is based on the principle of capillary pressure and fluid dynamics. FIGS. 3A–3C depict the ink level sensor 118 in an "ON" state, while FIG. 3D depicts the ink level sensor 118 in an "OFF" state. In the "ON" state the ink level tube 120 is full of ink. In the "OFF" state the ink level tube 120 is drained (i.e., free) of ink which indicates a low level ink condition of the ink reservoir 114 of the ink container 114. FIG. 3A depicts the ink container 110 of the present invention having an ink level, otherwise known as an ink front 202 within the first capillary member 200. The ink front 202 is a dividing line between an ink filled portion 206 of the first capillary member 200 and an ink empty portion 208 of the first capillary member 200. In FIG. 3A, the second capillary member 201 is completely filled with ink.

In operation of the ink level sensor 118, as long as the ink front 202 is above the upper port **120*a* (FIGS. 3A–3C), the tube 120 of the ink level sensor 118 is full of ink and is in static equilibrium. In other words, the ink level sensor 118 is in the "ON" state. However, when the ink front 202 reaches the top port 120*a* (FIG. 3D), the ink is sucked from the tube 120 of the ink level sensor 118 and into the second capillary member 201 due to an imbalance in the capillary pressures at the ink/air interfaces between the second capillary member 201 and the top port 120*a*. The resulting sudden (i.e., instantaneous) depletion of ink in the tube 120 of the ink level sensor 118 provides a binary fluidic indicator. In other words, the ink level sensor 118 immediately goes from the "ON" state to the "OFF" state indicating a low level ink condition for the ink container 110. Hence, the use of the term "binary" to describe the ink level sensor 118. Since the tube 120 of the ink level sensor 118 is transparent, the light detector 124, positioned adjacent to the tube 120, can detect when the tube 120 is empty (i.e., detect the binary fluidic indicator), whereupon the printer control electronics 108 coupled to the light detector 124 via transmission line 109, can notify a user of the low ink condition of the ink reservoir 114 and/or through calculations and estimation, an out of ink condition of the ink reservoir 114 of the ink container 110**.

As seen in FIG. 3A, the ink front 202 is very uneven and ever-changing due to deviations in the capillary member medium, materials and/or assembly. This uneven ink front 202 (i.e., ink level) exhibits an ink front variation 204 defined by the difference between a highest point 134 of the ink filled portion 206 of the first capillary member 200 and a lowest point 136 of the ink empty portion 208 of the first capillary member 200. As seen in FIG. 3B, as ink is continued to be drained (due to printing operation of the printhead 102) from the ink reservoir 114, and in particular the first capillary member 200, the ink within the ink reservoir 114 will drain first from the first capillary member 200 before any ink is drained from the second capillary member 201. This draining of ink from the first capillary member 200 before any ink is drained from the second capillary member 201 is due to the second capillary member 201 having a greater capillary pressure, and thereby a greater resistance to ink flow, than the first capillary member 200. As such, as seen in FIG. 3C, once the first capillary member 200 is completely drained of ink (i.e., ink filled portion 206 disappears and first capillary member 200 becomes completely defined by ink empty portion 208), the ink front variation 204 becomes nonexistent, and the ink front 202 is synonymous with the capillary member interface 300. In FIG. 3C, the ink front 202 is defined between ink empty portion 208 of the first capillary member and ink filled portion 302 of the second capillary member 201. As seen in FIG. 3D, with continued ink drainage from the ink reservoir 114, the ink now drains only from the second capillary member 201 because the first capillary member 200 is empty. The ink front 202 is now within the second capillary member 201 and is defined by the dividing line between the ink filled portion 302 of the second capillary member 201 and an ink empty portion 304 of the second capillary member 201. With continued ink drainage, eventually, the ink front 202 becomes uneven and the ink front variation 204 reforms. However, since the upper port 120*a* of the tube 102 of the ink level sensor 118 is positioned immediately adjacent to the capillary member interface 300, upon actuation of the ink level sensor 118 to its "OFF" state (i.e., drainage of the ink level tube 120) this ink front variation 204 between an ink empty portion 304 of the second capillary member 201 and an ink filled portion 302 of the second capillary member 201 is minimal. As such, since the ink front variation 204 is minimal, the ink condition of the container 110 prompted by this "OFF" state of the ink level sensor 118 is fairly accurate (i.e., precise) and reliable especially when compared to prior art single capillary member ink containers.

Figure 4:
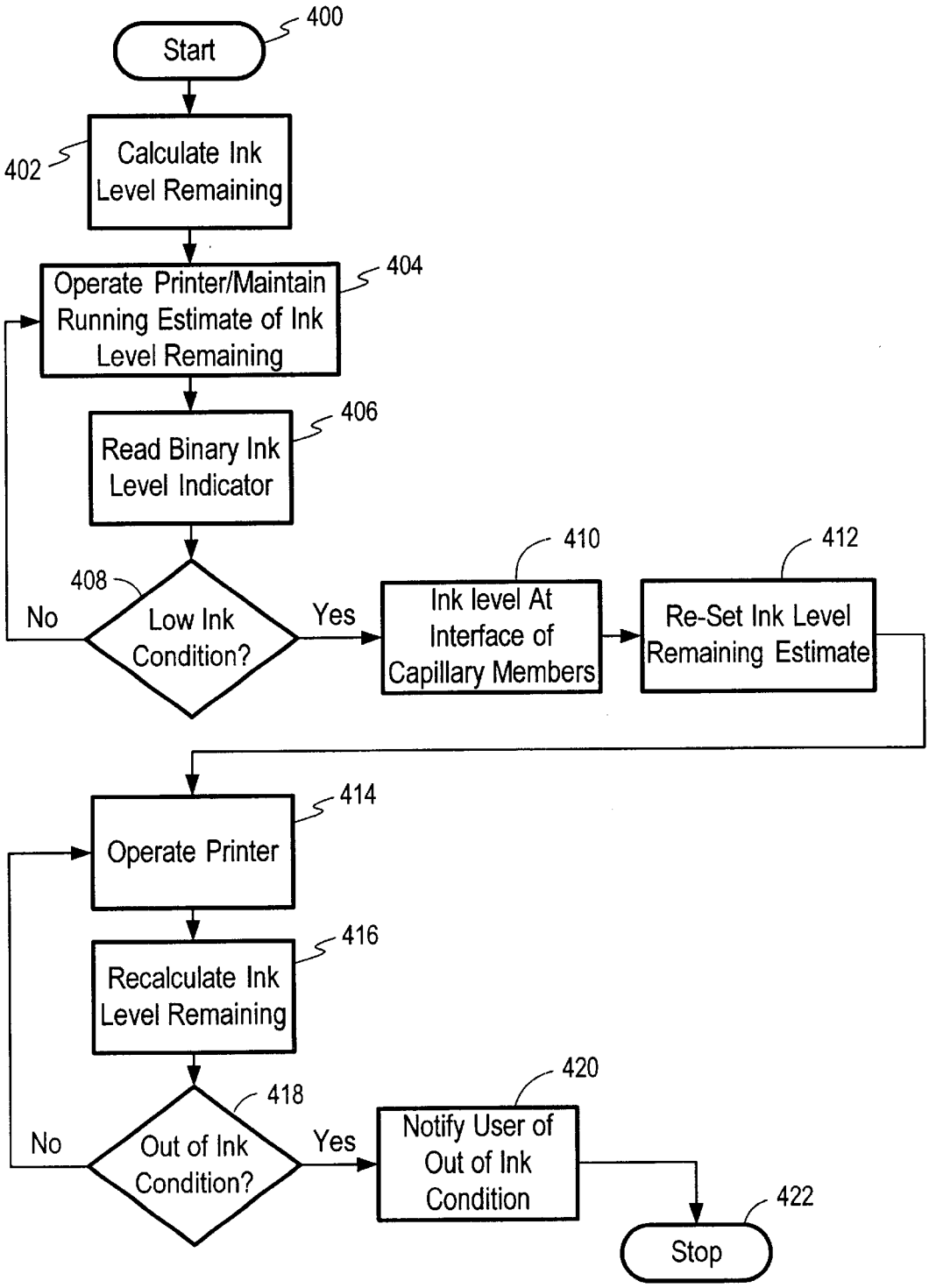
FIG. 4 is a flow chart depicting the process involving the ink level sensor of FIGS. 1 and 3A–3D for determining a low ink and out of ink conditions for the ink container in accordance with the present invention.
Figure 5:
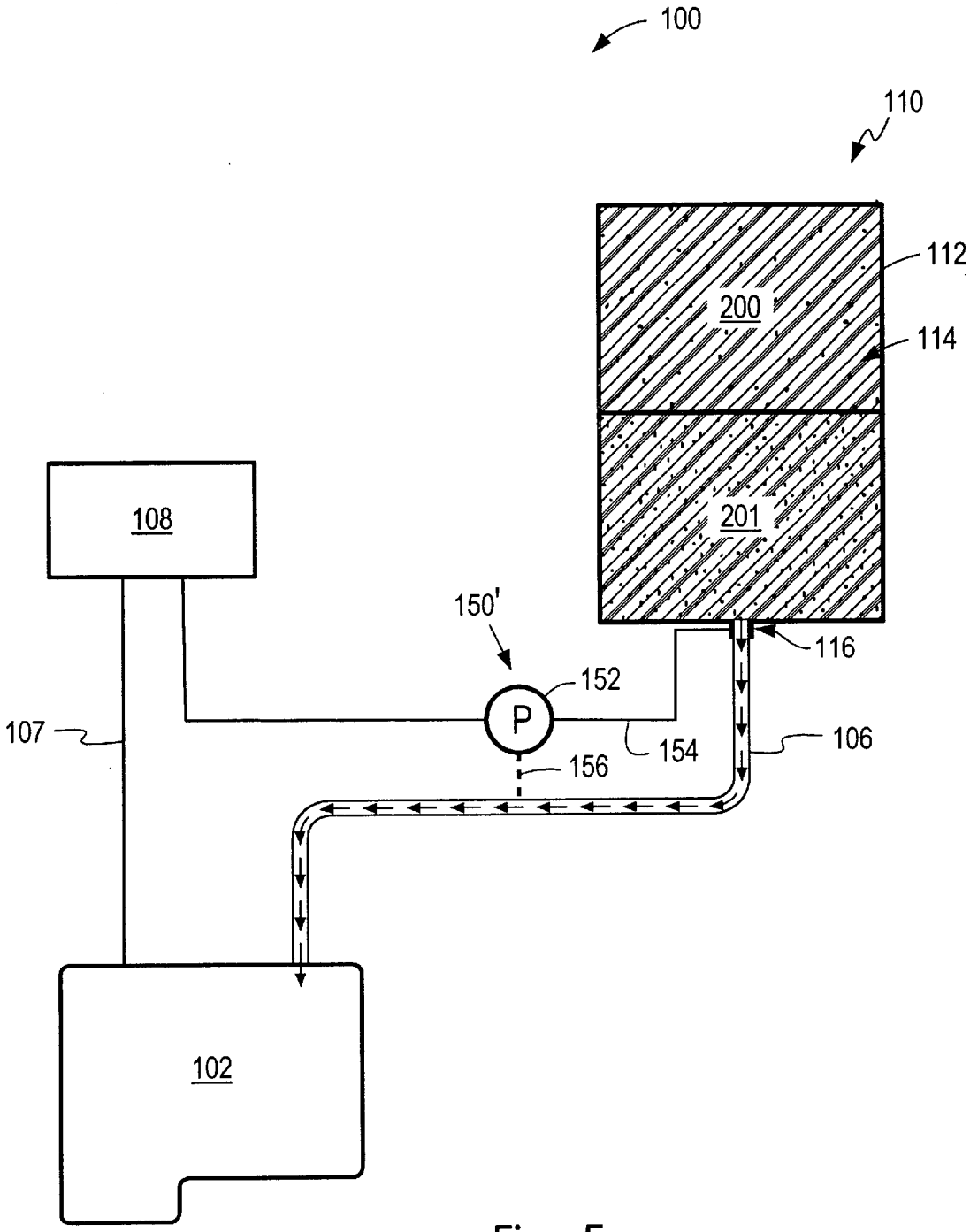
FIG. 5 is a schematic drawing of a printing system having a replaceable ink container with dual capillary members and an alternative ink level sensor in accordance with the present invention.

Turning to FIG. 4, the logic diagram shown depicts one manner a printing system can determine the remaining ink level (i.e., remaining ink volume) within the replaceable ink container 110 using the ink level sensor 118 to ultimately notify a user of an out of ink condition. Upon power up or when a print job starts (decision box 400), the printing system 100 calculates the ink level remaining in the ink container 110 (decision box 402). This calculation of usage time remaining is estimated by the printing system 100 in a known manner using drop volume coefficients and drop counting at the printhead 102 by way of the printer control electronics 108. In particular, the printing system 100 nominally knows how much ink is in the ink container 110 at the first printing. During printing, the printing system 100 counts the drops that are fired by the printhead 102, and calculates the estimated amount of ink used from that drop count and knowledge of the amount of ink per drop. This estimate of ink used is then subtracted from the starting estimate of ink remaining in the container 110, and the resulting value is stored as the amount of ink remaining in the container 110 (decision box 402).

Once the ink level remaining within the container 110 is known (assuming the printing system 100 has determined that the ink reservoir 114 of the ink container 110 is not empty) the printing system 100 can operate. The printing system 100 operates by carrying out print jobs. At the end of each print job the ink level remaining in the ink container 110 is recalculated such that the container 110 constantly maintains a running estimate of the ink remaining within the reservoir 114 (box 404). This estimate of ink remaining within the ink container 110 is not precise due variations in fill level within the container variations in drop weight and drop count.

During operation of the printing system 100, the ink level indicator 118 is constantly read by the light detector 124 (box 406). If there is ink in the tube 120 indicating an "ON" state of the ink level sensing mechanism 150 (i.e., if the tube 120 is not drained of ink so as to produce the "OFF" state indicator which indicates that there is ink within the ink reservoir 114), the printing system 100 can continue to operate and recycle through steps 404, 406 and 408. However, if at step 408 the tube 120 is drained of ink so as to produce the "OFF" state indicator of the ink level sensing mechanism 150, the printer control electronics 108 knows that the first capillary member 200 is completely empty and that the ink front 202 is coincident with the interface 300 between the first and second capillary members 200, 201 (box 410). As such, the printing system 100 knows precisely how much ink remains in the fully saturated second capillary member 201, since these values are programmed into the printing system 100 at manufacture. In one embodiment, at this point the printing system 100 can notify a user of a low ink condition of the ink container 110 so that the user has adequate time to purchase a replacement ink container before the current ink container 100 runs out of ink.

With this precise ink level, the printing system can re-set or re-calibrate the ink level remaining estimate of the ink container 110 which has been accounting all along (box 412). In other words, the estimate is replaced at that point with a more precise known value. At this point, the printing system 100 can continue to operate and perform print jobs (box 414). At the end of each print job, the ink level remaining in the ink container 110 is recalculated, as described previously, by estimating the amount of ink used from the drop count and knowledge of the amount of ink per drop, such that the container 110 constantly maintains a running estimate of the ink remaining within the reservoir 114 (box 416). In step 418, if based upon these calculations and estimations the printer control electronics 108 determines that the ink container 110 still has ink remaining (i.e., that there is not an out of ink condition), the printing system 100 can continue to operate and recycle through steps 414, 416 and 418. However, if at step 418 the printer control electronics 108 determines through calculation and estimations that the ink container 110 has no ink remaining (i.e., that there is an out of ink condition), the printing system 100 by way of the printer control electronics 108 notifies a user of the out of ink condition (box 420) and ceases operation (box 422) until the ink container 110 is replaced with an ink container containing a sufficient amount of ink for printing.

FIGS. 5–8 illustrate an alternative embodiment ink level sensing mechanism 150'. As seen best in FIG. 5, in this alternative ink level sensing mechanism 150' the ink level sensor 118 and the light detector 124 have been eliminated and replaced with a pressure sensor 152 linked to the printer control electronics 108 via the signal transmission line 109 and to the fluid outlet 116 of the ink container 110 via line 154. Alternatively, the pressure sensor 152 can be linked to the flexible conduit 106 via line 156. The pressure sensor 152 is not a binary device like the ink level sensor 150. The pressure sensor 152 is an analog device used to measure the pressure signal from early stages of ink container use through completion. In particular, the pressure sensor 152 senses changes in back pressure within the ink reservoir 114 of the ink container 110.

Figure 6:
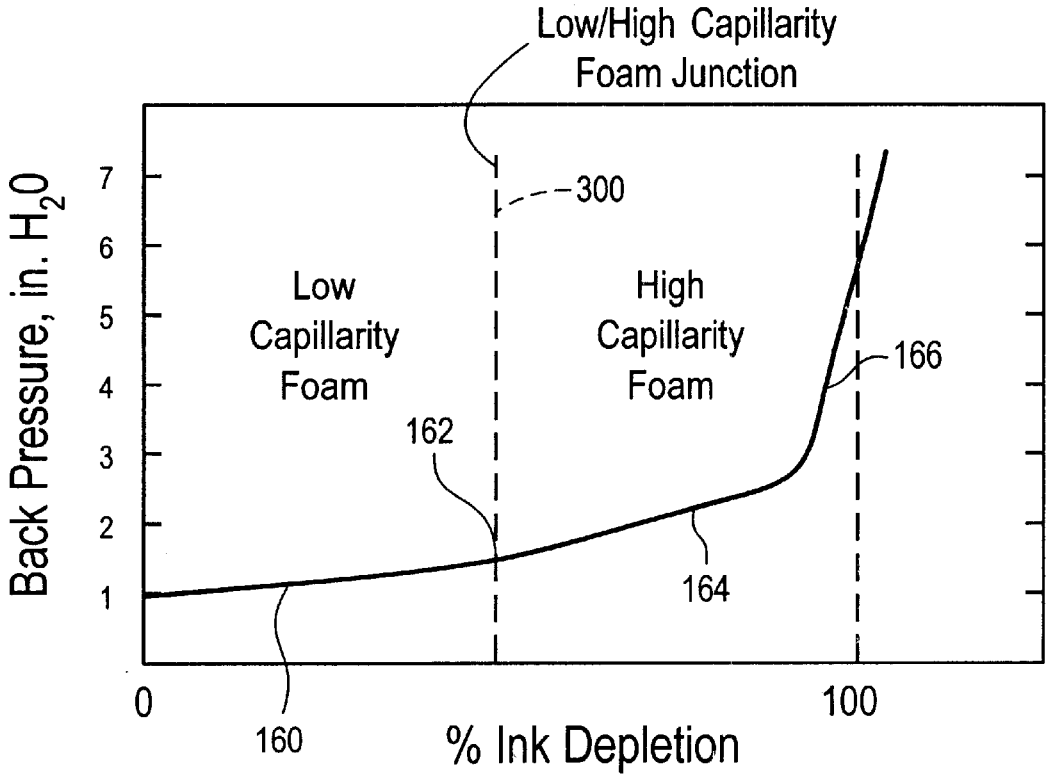
FIG. 6 is a graph illustrating the change in back pressure within the ink container reservoir as ink is drained from the ink container of the present invention.

As seen best in FIG. 6, as ink drained from the first capillary member 200, back pressure within the ink reservoir 114 increases linearly at a constant rate as represented by graph line portion 160. The slope of this pressure increase depends upon the capillarity. In other words, the less capillarity, the shallower the slope. At the capillary member interface 300, the slope of the back pressure line changes due to the increase in capillarity of the second capillary member 201 relative to the first capillary member 200. As ink is drained from the second capillary member 201, back pressure within the ink reservoir 114 increases linearly at a constant rate as represented by graph line portion 164 until ink is almost depleted wherein the back pressure increases and continues to increase (see graph line portion 166) until the back pressure is great enough to draw air into the printhead 102. As seen in FIG. 6, the slope of the graph line portion 164 is greater than the slope of the graph line portion 160 due to the greater capillarity of the second capillary member 201, relative to the first capillary member 200. This difference in slope of the graph line portions 160, 164 creates a bend or kink 162 (i.e., inflection point) in the back pressure curve. This kink 162, indicating a sharp increase in back pressure at the interface 300 between the first and second capillary members 200, 201, provides an indicator that is sensed by the pressure sensor 152. In other words, the printing system 100 immediately knows that the first capillary member 200 is completely empty and that the ink front 202 is coincident with the interface 300. The printing system 100 also knows precisely how much ink remains in the fully saturated second capillary member 201, since these values have been programmed into the printing system 100 at manufacture. This back pressure change, represented by kink 162, is picked up by the printer control electronics 108 which is coupled to the pressure sensor 152 via transmission line 109, so that the printer control electronics can notify a user of the low ink condition of the ink reservoir 114 and/or through calculations and estimation an out of ink condition of the ink reservoir 114 of the ink container 110.

Figure 7:
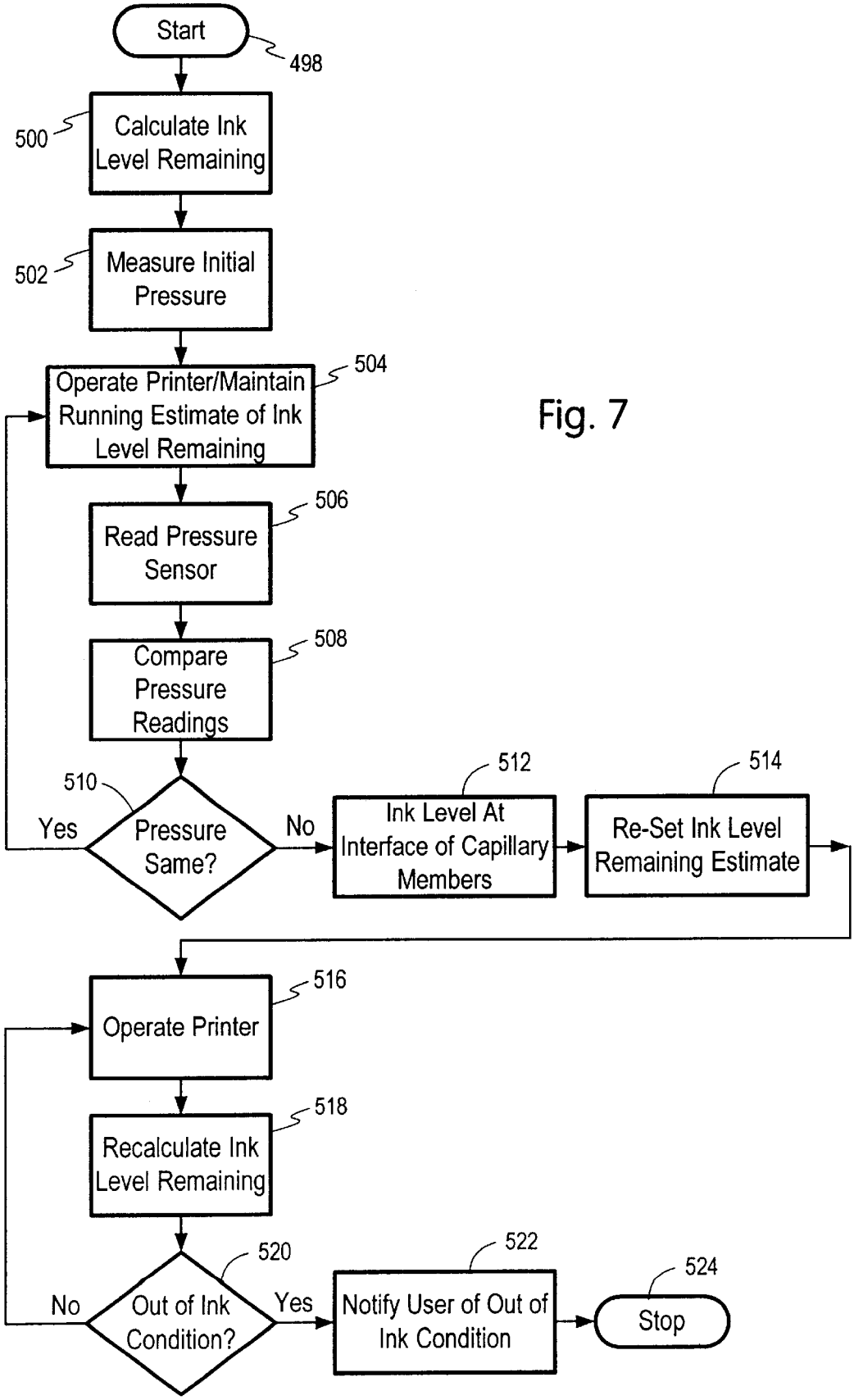
FIG. 7 is a flow chart depicting the process involving the alternative ink level sensor of FIG. 5 for determining low ink and out of ink conditions for the ink container in accordance with the present invention.

Turning to FIG. 7, the logic diagram shown depicts one manner a printing system can determine the remaining ink level (i.e., remaining ink volume) within the replaceable ink container 110 using the pressure sensor 152 to ultimately notify a user of an out of ink condition. Upon power up or when a print job starts (decision box 498), the printing system 100 calculates the ink level remaining in the ink container 110 (box 500). This calculation of usage time remaining is estimated by the printing system 100 in a known manner using drop volume coefficients and drop counting at the printhead 102 by way of the printer control electronics 108. In particular, the printing system 100 nominally knows how much ink is in the ink container 110 at the first printing. During printing, the printing system 100 counts the drops that are fired by the printhead 102, and calculates the estimated amount of ink used from that drop count and knowledge of the amount of ink per drop. This estimate of ink used is then subtracted from the starting estimate of ink remaining in the container 110, and the resulting value is stored as the amount of ink remaining in the container 110 (decision box 500).

Next, back pressure within the ink reservoir 114 of the ink container 110 is measured using the pressure sensor 152 linked to the printer control electronics 108 (box 502). Once the ink level remaining is known (assuming the printing system 100 has determined that the ink reservoir 114 of the ink container 110 is not empty) and the back pressure is known, the printing system 100 can operate by carrying out print jobs. At the end of each print job the ink level remaining in the ink container 110 is recalculated such that the container 110 constantly maintains a running estimate of the ink remaining within the reservoir 114 (box 504). This estimate of ink remaining within the ink container 110 is not precise due variations in fill level within the container variations in drop weight and drop count.

During operation of the printing system 100, the back pressure within the ink reservoir is constantly monitored using the pressure sensor 152 linked to the printer control electronics 108 (box 506). The printer control electronics 108 constantly monitor the back pressure by comparing new back pressure readings with previous back pressure readings (box 508). If the recent back pressure readings and the previous back pressure readings indicate a constant rate of increase in back pressure, this indicates that the ink front 202 has not reached the capillary member interface 300, which indicates that there is ink within the first capillary member 200. If this is the case, the printing system 100 can once again operate for a time and recycle through steps 504, 506, 508 and 510. However, if at step 510 there is a difference in the rate of increase in back pressure between the recent back pressure readings and the previous back pressure readings, this indicates that the ink front 202 is coincident with the capillary member interface 300 (i.e., a low ink condition in the ink container 110), and that the first capillary member 200 is completely empty (box 512). As such, the printing system 100 knows precisely how much ink remains in the fully saturated second capillary member 201, since these values are programmed into the printing system 100 at manufacture. In one embodiment, at this point the printing system 100 can notify a user of a low ink condition of the ink container 110 so that the user has adequate time to purchase a replacement ink container before the current ink container 100 runs out of ink.

With this precise ink level, the printing system 100 can re-set or re-calibrate the ink level remaining estimate of the ink container 110 which has been accounting all along (box 514). In other words, the estimate is replaced at that point with a more precise known value. At this point, the printing system 100 can continue to operate and perform print jobs (box 516). At the end of each print job, the ink level remaining in the ink container 110 is recalculated, as described previously, by estimating the amount of ink used from the drop count and knowledge of the amount of ink per drop, such that the container 110 constantly maintains a running estimate of the ink remaining within the reservoir 114 (box 518). In step 520, if based upon these calculations and estimations the printer control electronics 108 determines that the ink container 110 still has ink remaining (i.e., that there is not an out of ink condition), the printing system 100 can once again operate for a time and recycle through steps 516, 518 and 520. However, if at step 520 the printer control electronics determines through calculation and estimations that the ink container 110 has no ink remaining (i.e., that there is an out of ink condition), the printing system 100 by way of the printer control electronics 108 notifies a user of the out of ink condition (box 522) and ceases operation (box 524) until the ink container 110 is replaced with an ink container containing a sufficient amount of ink for printing.

The pressure sensor 152 described above can also be used to determine an out of ink condition for an ink container that includes only a single capillary member. In such an ink container, as ink is drained from the single capillary member, back pressure within the ink reservoir of the ink container would increases linearly at a constant rate until ink is almost depleted wherein the back pressure would abruptly increase and continue to increase until the back pressure is great enough to draw air into the printhead. The pressure sensor 152 can be used to sense this change in the rate of increase in back pressure and notify a user of an out of ink condition of the ink container.

This ink container 110 of the present invention allows the printing system 100 to reliably and accurately determine the ink level within the ink reservoir 114 of the ink container 110. In particular, by providing the ink reservoir 114 with a second capillary member 201 having a greater capillary pressure than a first capillary member 200 of the ink reservoir 114, the ink within the ink reservoir 114 will drain first from the first capillary member 200 and then from the second reservoir 201. Placement of the ink level sensor 118 immediately adjacent to the capillary member interface 300 between the first and second capillary members 200, 201, or sensing changes in the rate of increase in back pressure at this capillary member interface, with the sensor 118, 152 in fluid communication with only the second capillary member 201, minimizes the ink level variation 204 between an ink drained portion 304 of the second capillary member 201 and an ink filled portion 302 of the second capillary member 201. By minimizing the ink level variation 204 at the ink level sensor 118, the container-to-container variation in the indication of a low ink condition of an ink container 110 is substantially eliminated. In other words, the binary fluidic signal for a low ink condition produced by an ink level sensor 118, 152 occurs in each and every container 110 at substantially the same targeted ink level (i.e., with substantially the same amount of ink remaining in each and every ink container). Lastly, the ink container 110 of the present invention is relatively easy and inexpensive to manufacture.

Although the present invention has been described with reference to preferred embodiments, workers skilled in the art will recognize that changes may be made in form and detail without departing from the spirit and scope of the invention.

What is claimed is:

1. A replaceable ink container for providing ink to a printhead of a printing system, the ink container having a fluid outlet configured for connection with the printhead, the ink container comprising:

an ink reservoir including:

a first capillary member having a first capillary pressure; and a second capillary member having a second capillary pressure that is different than the first capillary pressure.

2. The replaceable ink container of claim 1 wherein the second capillary pressure is greater than the first capillary pressure.

3. The replaceable ink container of claim 2 wherein the first capillary member has a first resistance to ink flow, and wherein the second capillary member has a resistance to ink flow higher than the first resistance to ink flow of the first capillary member.

4. The replaceable ink container of claim 1 wherein the second capillary member is positioned adjacent the fluid outlet.

5. The replaceable ink container of claim 4 wherein the first capillary member is spaced from the fluid outlet by the second capillary member.

6. The replaceable ink container of claim 5 wherein the first capillary member has a first resistance to ink flow, and wherein the second capillary member has a resistance to ink flow higher than the first resistance to ink flow of the first capillary member.

7. The replaceable ink container of claim 5 wherein the second capillary pressure is greater than the first capillary pressure.

8. The replaceable ink container of claim 7 wherein each of the first capillary member defines at least half of the ink reservoir by volume.

9. The replaceable ink container of claim 8 wherein the first capillary member defines two-thirds of the ink reservoir by volume with the second capillary member defining the remaining one-third of the ink reservoir by volume.

10. The replaceable ink container of claim 7, and further including:

an ink level sensor for determining an amount of ink in the ink reservoir.

11. The replaceable ink container of claim 10 wherein the ink level sensor is a binary ink level sensor.

12. The replaceable ink container of claim 10 wherein the ink level sensor senses a low ink condition of the ink reservoir.

13. The replaceable ink container of claim 10 wherein the ink level sensor includes a C-shaped tube mounted to the ink container, the C-shaped tube having a first port a first distance above the fluid outlet and a second port a second distance above the fluid outlet, wherein the second distance is less than the first distance, and wherein both the first and second ports fluidically communicate with the ink reservoir.

14. The replaceable ink container of claim 13 wherein both the first and second ports fluidically communicate with only one of the first and second capillary members.

15. The replaceable ink container of claim 14 wherein both the first and second ports fluidically communicate with only the second capillary member.

16. The replaceable ink container of claim 15 wherein the first and second capillary members abut one another at a capillary member interface, and wherein the first port is positioned immediately adjacent to the capillary member interface.

17. The replaceable ink container of claim 16 wherein the C-shaped tube is transparent, and wherein the ink level sensor includes a light detector for detecting when the C-shaped tube is free of ink which defines a low ink condition of the ink reservoir.

18. The replaceable ink container of claim 10 wherein the first and second capillary members abut one another at a capillary member interface, and wherein the ink level sensor is a pressure sensor for sensing a change in back pressure within the ink reservoir at the capillary member interface.

19. The replaceable ink container of claim 18 wherein the pressure sensor is positioned at the fluid outlet.

20. A replaceable ink container for providing ink to a printhead of a printing system, the ink container having a fluid outlet configured for connection with the printhead, the ink container comprising:

an ink reservoir including:

a first capillary member; and a second capillary member that is different than the first capillary member; and an ink level sensor for determining an amount of ink in the ink reservoir.

21. The replaceable ink container of claim 20 wherein the ink level sensor senses a low ink condition of the ink reservoir.

22. The replaceable ink container of claim 20 wherein the ink level sensor includes a C-shaped tube mounted to the ink container, the C-shaped tube having a first port a first distance above the fluid outlet and a second port a second distance above the fluid outlet, wherein the second distance is less than the first distance, and wherein both the first and second ports fluidically communicate with the ink reservoir.

23. The replaceable ink container of claim 22 wherein both the first and second ports fluidically communicate with only one of the first and second capillary members.

24. The replaceable ink container of claim 23 wherein both the first and second ports fluidically communicate with only the second capillary member.

25. The replaceable ink container of claim 24 wherein the first and second capillary members abut one another at a capillary member interface, and wherein the first port is positioned immediately adjacent to the capillary member interface.

26. The replaceable ink container of claim 25 wherein the C-shaped tube is transparent, and wherein the ink level sensor includes a light detector for detecting when the C-shaped tube is free of ink which defines a low ink condition of the ink reservoir.

27. The replaceable ink container of claim 20 wherein the first and second capillary members abut one another at a capillary member interface, and wherein the ink level sensor is a pressure sensor for sensing a change in back pressure within the ink reservoir at the capillary member interface.

28. A replaceable ink container for providing ink to a printhead of a printing system, the ink container having a fluid outlet configured for connection with the printhead, the ink container comprising:

an ink reservoir including:

a first capillary member; and a second capillary member that is different than the first capillary member and is positioned immediately adjacent to the fluid outlet, wherein the first capillary member is spaced from the fluid outlet by the second capillary member, and wherein the first and second capillary members abut one another at a capillary member interface; and an ink level sensor for determining an amount of ink in the ink reservoir, wherein the ink level sensor is positioned immediately adjacent the capillary member interface so as to be in fluid communication with the ink reservoir.

29. The replaceable ink container of claim 28 wherein the ink level sensor fluidically communicates with only one of the first and second capillary members.

30. The replaceable ink container of claim 29 wherein the ink level sensor fluidically communicates with only the second capillary member.

31. The replaceable ink container of claim 28 wherein at the capillary member interface, the second capillary member has an ink level variation between an ink drained portion of the second capillary member and an ink filled portion of the second capillary member that is minimal.

32. The replaceable ink container of claim 28 wherein the first capillary member is more porous than the second capillary member.

33. A replaceable ink container for providing ink to a printhead of a printing system, the ink container having a fluid outlet configured for connection with the printhead, the ink container comprising:

an ink reservoir; and an ink level pressure sensor for determining an amount of ink in the ink reservoir, the ink level pressure sensor sensing a change in back pressure within the ink reservoir.

34. The replaceable ink container of claim 33 wherein the pressure sensor is positioned at the fluid outlet.

35. The replaceable ink container of claim 33 wherein the ink reservoir includes:

a first capillary member; and a second capillary member that is different than the first capillary member and is positioned immediately adjacent to the fluid outlet, wherein the first capillary member is spaced from the fluid outlet by the second capillary member, wherein the first and second capillary members abut one another at a capillary member interface, and wherein the ink level pressure sensor senses a change in back pressure within the ink reservoir at the capillary member interface.

36. A replaceable ink container for providing ink to a printhead of a printing system, the ink container having a fluid outlet configured for connection with the printhead, the ink container comprising:

an ink reservoir including:

at least one capillary member; and one additional capillary member, wherein the one additional capillary member abuts the at least one capillary member at a capillary member interface, and wherein at the capillary member interface, the one additional capillary member has an ink level variation between an ink drained portion of the one additional capillary member and an ink filled portion of the one additional capillary member that is minimal.

* * * * *